US006494644B1

(12) United States Patent
Scandaliato et al.

(10) Patent No.: US 6,494,644 B1
(45) **Date of Patent: *Dec. 17, 2002**

(54) PILE CONNECTOR AND METHOD OF INSTALLATION

(75) Inventors: Samuel Zengal Scandaliato; Michael Allen Cenac, both of New Orleans, LA (US)

(73) Assignee: Foundation Systems of Louisiana, Inc., New Orleans, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 07/636,774

(22) Filed: Jan. 2, 1991

(51) Int. Cl.[7] ..... E02D 5/22; E02D 5/52

(52) U.S. Cl. ..... 405/251; 405/250; 403/300; 403/306

(58) Field of Search ..... 405/250, 251, 405/252, 230; 403/300, 301, 305, 306

(56) References Cited

U.S. PATENT DOCUMENTS

| | | | | | |
|---|---|---|---|---|---|
| 1,683,108 | A | * | 9/1928 | Small | 405/250 |
| 1,971,691 | A | * | 8/1934 | Nadel | 405/250 X |
| 2,353,561 | A | * | 7/1944 | Hassett | 405/251 X |
| 2,912,829 | A | * | 11/1959 | Cobi | 405/250 |
| 2,932,952 | A | * | 4/1960 | Fox | 403/301 X |
| 2,938,355 | A | * | 5/1960 | Dougherty | 405/250 |
| 2,978,874 | A | * | 4/1961 | Baittinger | 405/251 |
| 3,003,323 | A | * | 10/1961 | Holt | 405/251 |
| 3,046,749 | A | * | 7/1962 | Blessey | 405/251 |
| 3,266,255 | A | * | 8/1966 | Dougherty | 405/251 |
| 3,924,413 | A | * | 12/1975 | Marsh | 405/251 |
| 4,537,534 | A | * | 8/1985 | Marsh | 405/251 |
| 4,695,203 | A | * | 9/1987 | Gregory | 405/230 |

FOREIGN PATENT DOCUMENTS

| | | | | |
|---|---|---|---|---|
| RU | 0681153 | * | 8/1978 | 405/251 |
| SE | 85932 | * | 3/1936 | 405/251 |

* cited by examiner

*Primary Examiner*—Heather Shackelford
*Assistant Examiner*—Jong-Suk Lee
(74) *Attorney, Agent, or Firm*—Milton M. Field

(57) ABSTRACT

A method of rapidly installing a composite pile structure of timber pile sections and a pre-selected connector having an opening smaller than a transverse dimension of a working end of a timber pile section. The lower pile section is driven into the ground to a convenient distance, the connector is driven onto the lower pile and the upper pile driven onto the connector, and the connection is rapidly made rigid.

3 Claims, 2 Drawing Sheets

PILE CONNECTOR AND METHOD OF INSTALLATION

RELATED PATENT APPLICATION

This application is related to co-pending U.S. patent application Ser. No. 07/379,323 filed Jul. 12, 1989, now abandoned.

BACKGROUND OF THE INVENTION

The present invention relates generally to piling and pile driving and more particularly to an improved piling connector and a unique method of connecting pilings. It is equally adaptable to both new construction and for repairing existing construction, and has particular utility in the repair of concrete slab foundations on pilings. Similarly, it is applicable in all terrain conditions in which pilings are used but has particular utility in the most difficult conditions such as saturated soils and terrains in which the water content exceeds complete saturation.

The problems which the present invention overcomes are long-standing and have been known for decades if not longer. For example, friction pilings of the type and size for which this invention is expected to be frequently employed typically might have a ten ton maximum rating. That is to say, such pilings typically are not able to resist a total downward force in excess of twenty thousand pounds. If the environment in which such pilings are to be used is expected to produce a downdrag force of two tons, the pilings may be analyzed as consisting of a two-ton downdrag portion and only an eight-ton frictional resistance portion. The conservative designer will then subtract the two tons of downdrag force from the eight tons of frictional resistive force to obtain a net maximum of six tons per piling and then, in order to have a reasonable margin of safety, use one-half that number, or three tons, as the design capacity of such pilings. Knowing the maximum load which the particular foundation must support, the designer would then calculate the number of pilings needed and distribute that number about the foundation.

The difficulty with super-saturated soils, and even in many soils that are less than saturated but near saturation, is that such soils usually will not remain uniformly wet. When dry, or even when only partially dry, such soils experience enormous contractions, and as they settle, extremely strong downward forces are created. When the downdrag exceeds the maximum resistive force of the friction pilings, failure results.

Due to the difficulty of access, repair of such a failed foundation is typically quite expensive. For reasons of economy, most friction pilings are wooden poles or, literally, de-barked trees. To prevent decay, and subsequent foundation failure as a result therefrom, wooden pilings are commonly treated with preservatives. However, full-length treated pilings typically cost from twice as much as untreated pilings of the same length and diameter, up to three times as much.

Generally, the deeper a piling is set, the greater is its capacity to resist downward forces. In fact, it is not at all uncommon for the resistive force or resistive capacity of such pilings to increase in a non-linear manner with depth. A typical soil profile in which pilings are normally used may provide three tons of resistive capacity at thirty feet of piling length, four tons at forty feet, but perhaps eight tons at sixty feet. Thus it is apparent that the deeper the designer places the pilings, the greater the capacity, perhaps non-linearly greater, and the fewer the number of pilings needed. Offsetting this advantage, however, is the fact that the longer the one-piece piling, the greater is the cost—also a non-linear function. If the installed cost of a treated thirty-foot residental or light commercial piling (e.g., a Modified Class Five piling) in a particular locale is fifty-two dollars, for example, the cost for a forty-foot piling might be seventy-five dollars, and the nearest comparable sixty-foot piling, three hundred thirty dollars.

The dramatic increase in costs for exceeding forty feet is due to several factors, one of which is that the piling material itself must be of a larger class in order to achieve the desired length; this necessitates a non-linear increase in the cost of the material employed. In addition, small "house rigs" can be used to drive pilings up to forty feet; the costs for driving piles with such equipment is typically as low as fifty cents per foot. Going beyond the 40-foot limit, however, exceeds the capacity of such small equipment; much larger driving rigs must be used, the cost of which may be as much as five dollars per foot. Combined with the non-linear cost-of-material increase, the final, installed cost of a sixty-foot piling might typically be as much as four or five times the final, installed cost of a forty-foot piling.

The cost for treating extra-long pilings also increases non-linearly because of the more expensive equipment needed to treat such pilings. It is known that a piling need not be treated along its entire length in order to preserve it; only the portion above the lowest water table need be treated. However, since most treatment means call for the preservatives to be forced into the wood pores under high pressure, and since the non-uniformity of the raw materials makes consistent sealing around the circumference of the work pieces difficult to achieve, equipment which will pressure-treat only an end of a piling is typically either not available or so expensive as to not afford any savings.

The prior art has therefore looked to various means of connecting shorter pilings, i.e., each of forty feet or less, so as to make an effective and economically affordable longer piling. One such early attempt is that of U.S. Pat. No. 1,073,614, "Pile Splice", to W. A. McDearmid. McDearmid employs a specially-cast tubular body with an integral transverse partition dividing the body into two chambers of equal diameters. The device is placed over a snugly fitting lower pile, a short pin is driven longitudinally into the lower pile with one end protruding, the upper pile is then dropped into the upper chamber onto the pin, and a bolt is then passed horizontally through each chamber and secured by a nut on the distal end thereof. Several disadvantages are presented by this approach, however. One such disadvantage, if the holes in the pilings are pre-drilled, is the difficulty of precisely aligning the holes in the environment intended, i.e., under water or in semi-watery mud. If the holes are not pre-drilled in the pilings, it is virtually certain that a bolt secured through the piling in that environment would often not meet the opposite hole in the chamber.

Perhaps a greater disadvantage of the McDearmid splice, however, is the necessity to adapt or pre-prepare the ends of the pilings to be received in the connector. Not only is this step an additional expense, but if the pilings do not fit quite snugly within both chambers, there will be a tendency for the splice to act not like a rigid connection but pin-like about one or both horizontal bolts until further rotation is prohibited by the walls of the chambers. At this point an eccentricity—perhaps a destabilizing eccentricity—will already have been introduced into the system. The amount of resistance which the small, vertical pin would provide to such a moment is expected to be negligible.

Another approach is that of U.S. Pat. No. 4,525,102, "Timber Pile Connection System", to Gerard J. Gillen, which also discloses a number of other prior approaches to this problem. Gillen appears to call for a hollow splice to be driven internal to each piling with a confined levelling material therebetween to avoid point or edge stresses and to distribute the forces at the interface more widely. Such an internal splice is of course at least partially destructive of the piling material. In addition, the piling itself becomes the "weakest link" in that only a small fraction of the piling material remains exterior to the splice to hold the splice in place. A small error in aligning the splice along the longitudinal axis could easily cause failure during subsequent driving.

Further, it is apparent that the technique of Gillen will not produce a rigid mechanical joint. The joint will be held together only by the force of friction between a piling end and the connector, and once that resistive force is exceeded, the joint will be expected to come apart. This is equally true whether the disrupting force is due to a moment about the joint or to an in-line force applied during driving. The Gillen technique may be expected to "drive off" the lower pile from time to time during routine pile driving, and to buckle the joint if a more resistive formation such as sand should be encountered.

Swedish Patent 85,932 discloses the use of a suitable number of randomly placed flat bars or straps over the joint between two pilings secured by nails. An internal dowel pin, comprising a central collar portion and a tapered pin portion protruding into each end of the pilings, is apparently relied upon for rigidity. The flat bars are intended to prevent the joint from being pulled apart, but they would not be expected to be able to resist any but small bending moments.

U.S. Pat. No. 4,696,605, "Composite Reinforced Concrete And Timber Pile Section And Method Of Installation", also to Gillen, employs a means of connecting which apparently relies upon the rigidity of the concrete pile itself to maintain a rigid joint. While technically sound, such a method may often be economically impractical.

U.S. Pat. No. 3,266,255, "Drive-Fit Transition Sleeve", to Dougherty, employs a pair of flanged pipes telescoped one inside the other and force fitted to each other, much like a plug-and-socket arrangement. Dougherty, however, is obviously limited to connecting metal pilings, and calls for connecting the separate pieces of his connectors to the pilings by welding.

SUMMARY OF THE INVENTION

The present invention involves an improved piling connector which can transfer a bending moment and direct forces across a joint of a composite pile and a unique method of driving composite piles. Unlike pin-type connectors, or connectors which function essentially like a pin-type connector, the connector of the present invention will not allow one pile of a composite pile system to rotate with respect to the other or to induce an eccentricity into the overall, combined column. Further, a lower pile of this system may not be "driven off" the joint while driving the pile assembly, and the connector may be chosen such that it will not be the weakest link in the assembly. Still further, no special preparation or sizing of the ends of the pilings must be done in order to employ the present invention.

A preferred embodiment of the improved connector of the present invention comprises two rigid tubular members joined by a rigid ring or plate with at least one opening permitting fluid communication between the tubular members. Each tubular member preferably has a plurality of holes in the wall thereof, spaced apart both circumferentially and longitudinally, with a deflector attached to the outer wall in alignment with and spaced apart from each hole. When employing one preferred method, a pile is driven in the customary manner until the upper end is at a convenient height above ground level. The battered end is sawn off, as is customary when driving wooden piles. An open end of the connector is then placed on the upper end of the piling, and is rapidly driven onto the piling by the driver hammer. Outer portions of the piling are peeled off by the connector as it is being driven onto the piling, and such peelings are deflected away from the holes in the wall of the connector by the deflectors. The connection is then made rigid, preferably by screwing lag screws, of a size sufficient to permit the transfer of forces between piling and connector, through the wall openings and into the piling. An end of the second piling is then positioned above the upper end of the connector, and that piling is driven into the connector and similarly made rigid, at which point the driving of the composite pile assembly may recommence. If desired, the lag screws may be inserted into both ends of the connector simultaneously.

It is to be noted that no preparatory work has to be done on the piling ends to prepare them for insertion into the connector. Rather, the chambers of the connector are selected so as to accomodate the particular piling ends. While it is preferable to size such chambers so that no voids will exist between the connector walls and the piling, it is not essential to do so inasmuch as the lag screws may be installed in such a manner as to resist bending moments also.

Piling systems of the type contemplated herein are also capable of resisting considerable forces in tension.

A variation of this technique has been found preferable for joining wooden and metal pilings, as in the repair of existing foundations where space for working is extremely limited. This techique is often useful where too few pilings have been employed, where too short pilings have been employed, or where the upper ends of the pilings have dry rotted or are not connected to the foundation they were intended to support. In a preferred application of this technique, a small excavation is made to expose the upper end of the piling to be extended or repaired or to be connected to the foundation. The connector is then positioned on top of such piling and forced into snug engagement therewith, preferably by hydraulic ram. This portion of the connection may then be made rigid as described above. Short sections of wooden or metal pilings may then be employed, sequentially as necessary, until the desired depth is reached or the desired resistance is encountered If metal members have been used, they may be left in place as is, if desired, or a continuous concrete column may be created by pouring cement therein.

In still another variation, new pilings may be driven under an existing foundation by employing a succession of short pilings.

A BRIEF DESCRIPTION OF THE DRAWINGS

A better understanding of the invention can be had when the detailed description of a preferred embodiment, set forth below, is considered in conjunction with the drawings, in which.

DETAILED DESCRIPTION OF PREFERRED EMBODIMENTS

It is to be understood that the following detailed description is of preferred embodiments only and is in no way limiting of the generality of the present invention.

Figure 1:
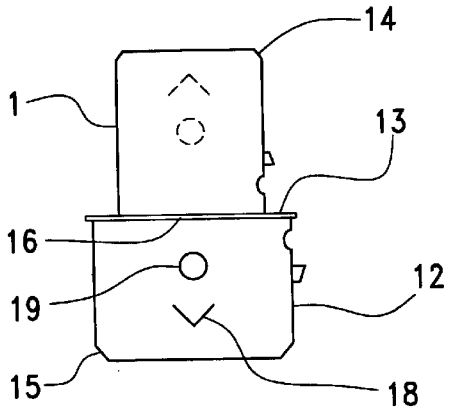
FIG. 1 is a sectional view of the connector of the present invention.
Figure 2:
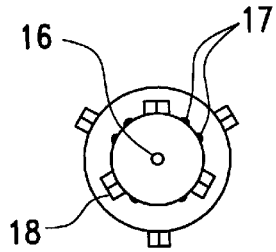
FIG. 2 is a plan view of such connector viewed from above.
Figure 3:
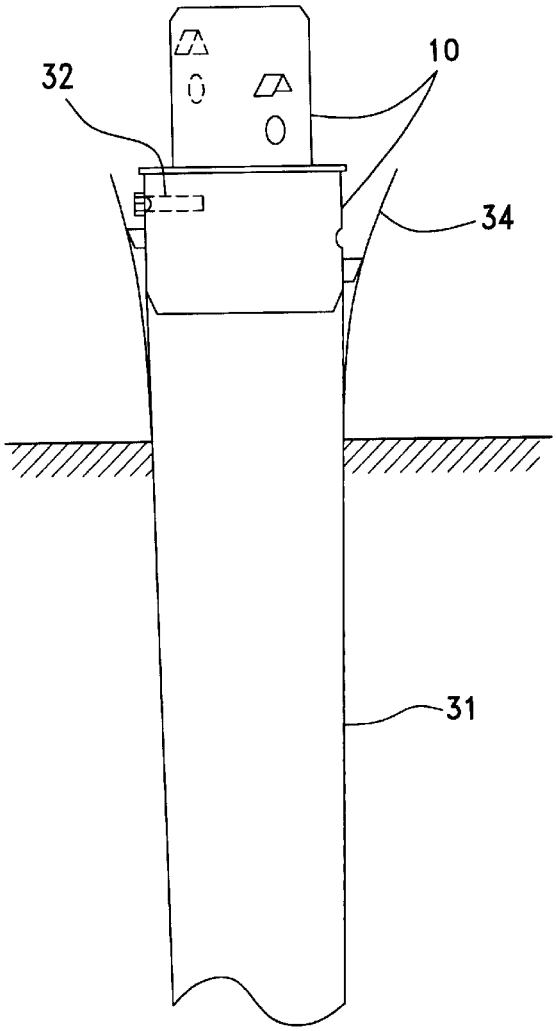
FIG. 3 is an elevation view of a preferred method of the present invention illustrating the driving of the connector onto a first, unprepared piling end and the insertion of a first rigid connecting means, said connector being ready to receive the remainder of the rigid connecting means and then the upper piling.
Figure 4:
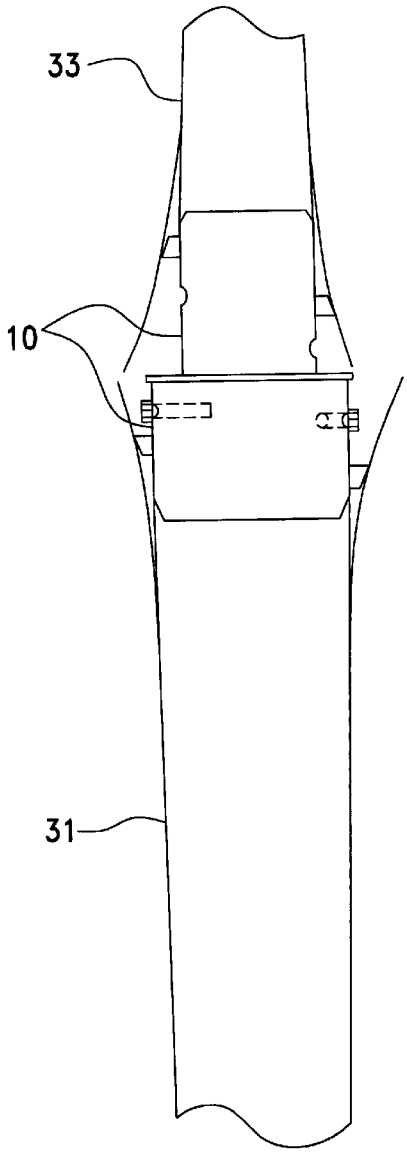
FIG. 4 is an elevation view of a preferred method illustrating the driving of the upper wooden piling into the upper end of the connector of the present invention.
Figure 5:
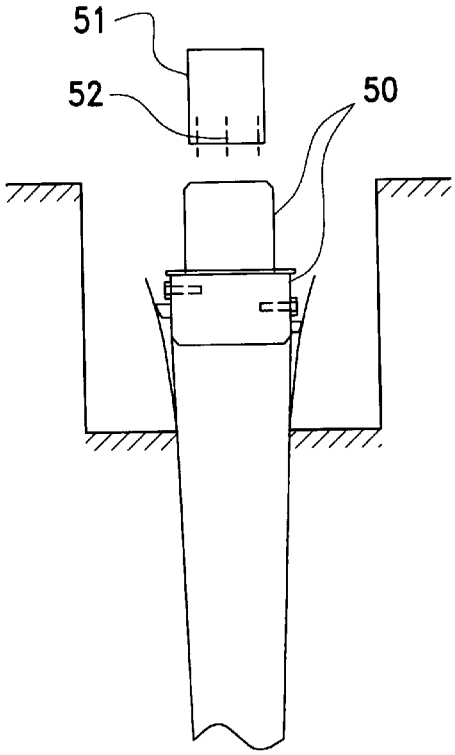
FIG. 5 is an elevation view of another preferred method illustrating the employment of the present invention with a metal piling.
Figure 6:
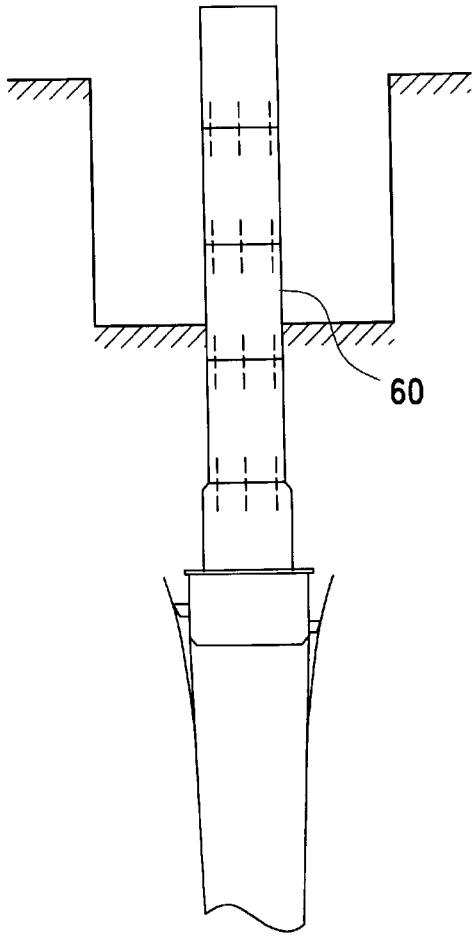
FIG. 6 is an elevation view of said other preferred method illustrating said metal piling ready to receive the pouring of a continuous concrete column inside the shell of said metal piling.
Figure 7:
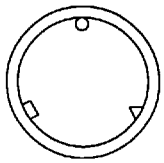
FIG. 7 is a plan view of one such metal piling from an end thereof.
Figure 8:
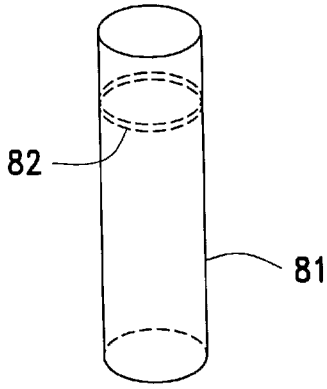
FIG. 8 is a view of another specialized connector.

FIGS. 1 and 2 illustrate a preferred connector of the present invention. FIGS. 3 and 4 illustrate preferred methods of employing such connector with various composite pile systems, while FIGS. 5 and 6 illustrate the use of a variant of such connector. FIG. 7 and 8 illustrate other preferred connectors.

The connector 10 of FIGS. 1 and 2 may be of any desired shape and size. While several different shapes have been found suitable, it has been found quite economical to fabricate the connector out of tubular members 11 and 12 and a flat plate 13. It has also been found preferable to have the ends 14 and 15 of members 11 and 12 chamfered to permit easier "biting" when used with wooden pilings. Also, when used with wooden pilings, it has been found preferable in most circumstances to size the members 11 and 12 such that they are slightly smaller than the pilings to be connected, thereby automatically insuring a very tight fit regardless of variations in the pilings. It is to be understood that, if tubular, the diameter may be of whatever dimension is desired.

As may be seen from FIGS. 1 and 2, if a flat plate is used as the connecting element 13, it is preferable to have at least one opening 16 to permit fluid communication between the interiors of members 11 and 12. It has also been found preferable, when welding either member 11 or 12 to connecting element 13, to do so in discontinuous welds 17 so that the fluid may escape from the interior of such members to the exterior. While deflectors 18 are not essential to the present invention, it is a time- and money-saving feature to have some means of deflecting the peelings 34 of the pilings away from wall openings 19. With a connector so constructed, when using the system in the field one need not bother to cut away the peelings or otherwise bother with them in order to rapidly make the joint rigid.

Deflectors 18 may be of any convenient size and shape. It has been found quite convenient to employ short segments of "angle iron" or "flat bars" for this purpose, as they are easily welded to outer periphery members 11 and 12.

FIG. 3 illustrates a step in the method of using the connector of the present invention with a wooden piling. If a new piling is being driven, the driving is stopped when the upper end of the piling is at a convenient work height. The connector 10 is then positioned on top of the piling, and at the desired angular orientation, and driven by the pile driver (not shown) onto the end of lower piling 31. Deflectors 18 have deflected the outer or "excess" portions of piling 31 a distance away from openings 19 sufficient to permit ready access to openings 19. As shown in FIG. 3, one rigid connector 32 has been inserted into piling 31; after all the rigid connections have been made, connector 10 is then ready to receive the upper piling.

If the upper piling 33 is also to be a wooden piling, it is then positioned and aligned as desired and driven into connector 10 as shown in FIG. 4, at which point it too is ready to be made rigid and then driven to the desired depth. Alternatively, all rigid connections may be made after connector 10 has received the upper piling.

If the upper piling is not to be a wooden piling—as frequently is the case when repairing existing construction—a metal piling or structural member 51 may be connected to connector 50 of FIG. 5. Depending upon the application, one or a series of such members 51 may be employed and left in place, or a continuous concrete column may be created by pouring cement inside such member(s) 51.

Structural members 51 may conveniently be comprised of short sections of pipe of any desired diameter. As shown in FIGS. 5–7, such segments may be rapidly connected in the tight space under an existing structure by previously welding a plurality of finger-like members 52 to the inside of such members 51. As shown, the members 52 may be fastened to one end only of members 51, or, if desired, they could be fastened to both ends of one member and alternated with a member having no members 52. As shown in FIG. 7, the shape of such members 52 is immaterial, the only requirement being sufficient strength to resist any expected bending moments.

A safer structure will of course result if a continuous concrete column is created upon completion by pouring a cement mixture into the continuous cavity internal to the metal column 60.

If an entirely new piling is to be constructed under an existing structure, it is convenient to begin by using as the first metal section a member 81 which is not open throughout its length. A most convenient structure is afforded by welding a solid plate 82 inside such member at a distance from the top sufficient to receive the finger-like members 52. By having such plate spaced away from the bottom of such member, the member may easily penetrate the soil, initially, and become stabilized in direction, while simultaneously preventing the soil or mud from entering the full length of the column. Member 81 may in some circumstances be used in place of member 50.

Other alternate forms of the present invention will suggest themselves from a consideration of the apparatus and practices hereinbefore discussed. Accordingly, it should be clearly understood that the systems and techniques depicted in the accompanying drawings, and described in the foregoing explanations, are intended as exemplary embodiments of the invention, and not as limitations thereto.

We claim:

1. A method of installing a piling system of the type having a plurality of timber pile sections and at least one connector, comprising the steps of:

a. selecting first and second timber pile sections having an upper end and lower end, respectively, of known maximum dimensions transverse to the longitudinal axes of said sections;

b. selecting a connector having a lower opening and an upper opening of known minimum transverse dimensions at least one of which being smaller than at least one of said maximum dimensions;

c. driving said first timber pile section into the earth to a pre-selected distance;

d. positioning said pre-selected connector above the upper end of said first timber section;

e. driving said connector onto said first timber section so as to deflect any timber shavings away from the periphery of said connector;

f. positioning the lower end of said second timber section above the upper opening of said pre-selected connector, and driving said timber section into the upper opening of said pre-selected connector; and g. making at least one connection between said timber pile sections and said connector a rigid connection.

2. A method of extending or repairing a pre-existing piling, comprising the steps of:

a. selecting a first connector with a lower end having an opening sized so as to at least partially receive an end of said preexisting piling without the aid of impulsive force, and an upper end adapted to receive a second connector by translational motion only;

b. causing said first connector to engage an end of said pre-existing piling and making the connection therebetween a rigid connection;

c. causing said second connector to engage said upper end of said first connector; and d. forcing said piling and said first and second connector to a pre-selected depth or a pre-selected resistive force level.

3. An improved piling system of the type having first and second timber pile sections and a connector with chambers for receiving said sections, the improvement comprising:

a. connector means for shaving an excess portion of said first timber pile section while receiving the same;

b. means for automatically deflecting said shavings from at least a portion of the external periphery of said connector; and c. means for rapidly making the connection between one of said pile sections and said connector rigid under field conditions and without advance preparation of said timber pile section end, so as to enable said connector to transmit forces directly and resist bending moments.

* * * * *